US011751663B2

(12) United States Patent
Lin

(10) Patent No.: US 11,751,663 B2
(45) Date of Patent: Sep. 12, 2023

(54) MAGNETIC CAP ASSEMBLY AND A CONTAINER USING THE SAME

(71) Applicant: Libo Cosmetics Co., Ltd., Taichung (TW)

(72) Inventor: Hsiao-Yun Lin, Taichung (TW)

(73) Assignee: Libo Cosmetics Co., Ltd., Taichung (TW)

( * ) Notice: Subject to any disclaimer, the term of this patent is extended or adjusted under 35 U.S.C. 154(b) by 756 days.

(21) Appl. No.: 16/684,571

(22) Filed: Nov. 14, 2019

(65) Prior Publication Data

US 2021/0145149 A1 May 20, 2021

(51) Int. Cl.

| | |
|---|---|
| ***A45D 34/00*** | (2006.01) |
| ***B65D 51/18*** | (2006.01) |
| ***B65D 51/28*** | (2006.01) |
| ***A45D 40/18*** | (2006.01) |
| ***A45D 2/48*** | (2006.01) |

(52) U.S. Cl.

CPC ..... *A45D 40/18* (2013.01); *A45D 2/48* (2013.01); *A45D 34/00* (2013.01); *B65D 51/18* (2013.01); *B65D 51/28* (2013.01); *B65D 2313/04* (2013.01)

(58) Field of Classification Search

CPC ..... B65D 2313/04
USPC ..... 220/230
See application file for complete search history.

(56) References Cited

U.S. PATENT DOCUMENTS

| | | | | |
|---|---|---|---|---|
| 9,592,935 | B1 * | 3/2017 | Jacob | A45D 40/265 |
| 11,230,464 | B2 * | 1/2022 | Jacob | B67C 3/24 |
| 2008/0066774 | A1 * | 3/2008 | Befve | A45D 34/045 132/218 |
| 2012/0294666 | A1 * | 11/2012 | Jang | A46B 17/04 401/126 |
| 2017/0088305 | A1 * | 3/2017 | Jacob | B65D 1/0246 |
| 2017/0127802 | A1 * | 5/2017 | Chen | A45D 40/265 |
| 2017/0265618 | A1 * | 9/2017 | Eberlein | A45D 34/045 |
| 2019/0239618 | A1 * | 8/2019 | Wolfe | B65D 51/32 |
| 2020/0146422 | A1 * | 5/2020 | Kamboj | A45D 40/16 |
| 2020/0383457 | A1 * | 12/2020 | Park | A45D 40/265 |
| 2021/0321747 | A1 * | 10/2021 | Niedermann | A45D 34/00 |
| 2023/0002123 | A1 * | 1/2023 | Lin | A45D 40/00 |

FOREIGN PATENT DOCUMENTS

| | | | | |
|---|---|---|---|---|
| CN | 108041792 A * | 5/2018 | | A45D 40/00 |
| FR | 2800040 A1 * | 4/2001 | | B65D 41/02 |
| KR | 2020170006481 A * | 5/2017 | | |
| WO | WO-2019153167 A1 * | 8/2019 | | |

* cited by examiner

*Primary Examiner* — Jacqueline T Johanas
*Assistant Examiner* — Sarah Woodhouse
(74) *Attorney, Agent, or Firm* — BRUCE STONE LLP; Joseph A. Bruce

(57) ABSTRACT

A magnetic cap assembly is used to close a bottle, grip or box. The magnetic cap assembly includes an external cap, magnets and an internal cap. The magnets are inserted in the external cap. The internal cap is fitted in the external cap, thereby keeping the magnets in the external cap. The internal cap is used to close the bottle, grip or box.

3 Claims, 18 Drawing Sheets

MAGNETIC CAP ASSEMBLY AND A CONTAINER USING THE SAME

BACKGROUND OF INVENTION

1. Field of Invention

The present invention relates to a container for cosmetics and, more particularly, to a container that includes a magnetic cap assembly.

2. Related Prior Art

U.S. Pat. No. 7,467,440 discloses a virtual hinge 10 that includes two hinge plates 12 and 14, two magnets 16 and two magnets 18. The hinge plates 12 and 14 are made of a non-magnetic material. In the vicinity of a hinge axis 20, the magnets 16 are attached to the hinge plate 12, and the magnets 18 are attached to the hinge plate 14. In use in a case 30, the hinge plate 12 is connected to a cover 32 of the case 30 and the hinge plate 14 is connected to a base 34 of the case 30. Thus, the cover 32 can be pivoted relative to the base 34 about the hinge axis 20 between an open position and a closed position due to the use of the virtual hinge 10.

US Patent Application Publication No. 20190133292 discloses a container for cosmetics. The container includes a body 1, a cover 2 pivotally connected to the body 1, a coupling member 3 connected to the body 1, and a fastening member 4 connected to the cover 2. The coupling member 3 is a magnet and the fastening member 4 is a piece of iron. The container is opened when the piece of iron is away from the magnet. When the container is closed, the piece of iron is attracted to the magnet so that the container is closed tightly.

SUMMARY OF INVENTION

It is an objective of the present invention to provide a magnetic cap assembly.

To achieve the foregoing objective, the magnetic cap assembly includes an external cap, magnets inserted in the external cap, and an internal cap fitted in the external cap, thereby keeping the magnets in the external cap.

It is another objective of the present invention to provide a magnetic container.

To achieve the foregoing objective, the magnetic container includes a magnetic cap assembly operable to close a bottle, grip or box. The magnetic cap assembly includes an external cap, magnets inserted in the external cap, and an internal cap fitted in the external cap, thereby keeping the magnets in the external cap. The internal cap is used to close the bottle, grip or box.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF EMBODIMENTS

Figure 1:
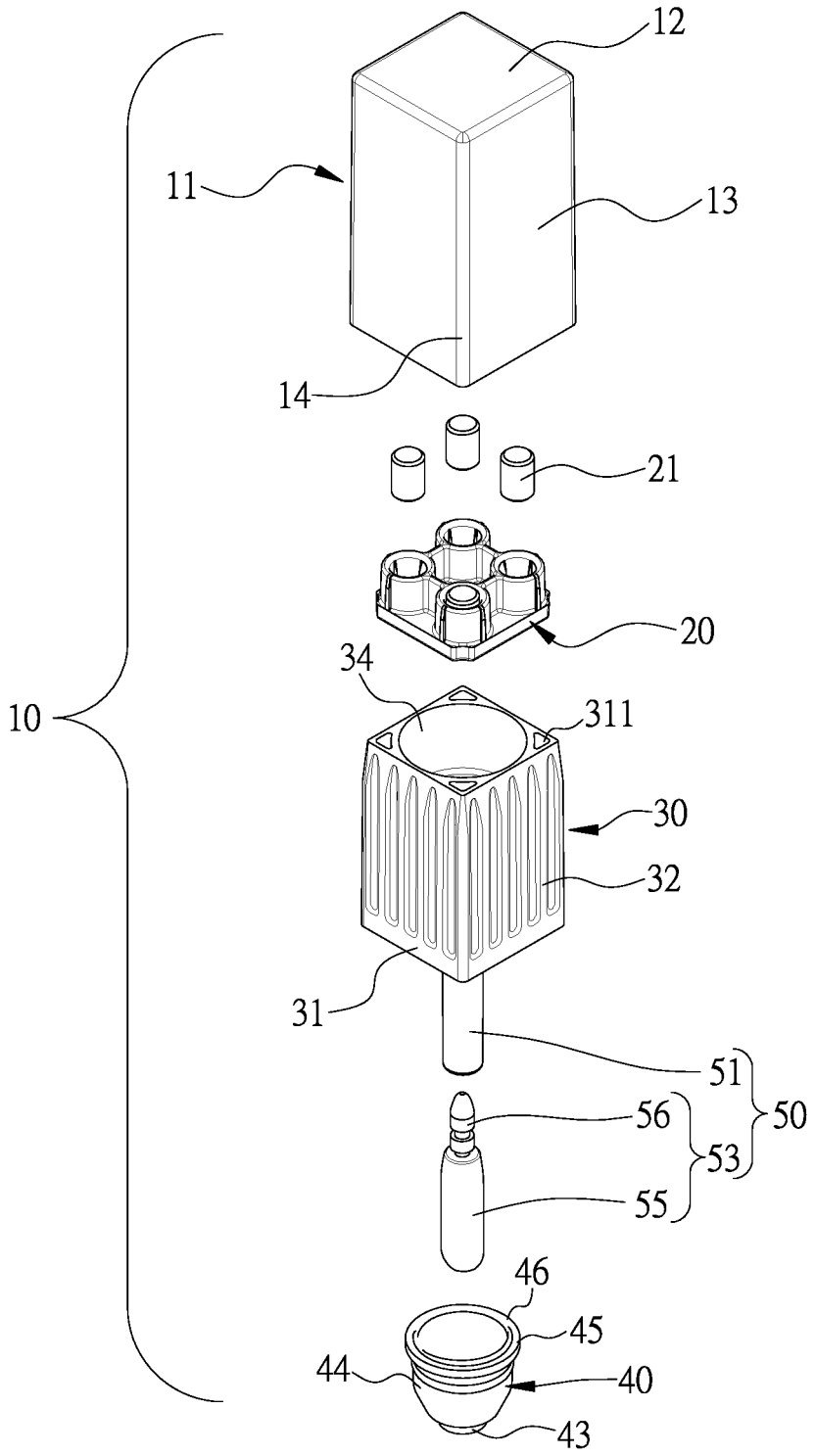
FIG. 1 is an exploded view of a magnetic cap assembly according to the preferred embodiment of the present invention.

Referring to FIGS. 1 through 11, there is shown a magnetic cap assembly 10 according to a first embodiment of the present invention. The magnetic cap assembly 10 is used in a container for cosmetics so that the container attracts another container. The cosmetics can be mascara or lip gloss for example. The container can include a jar or bottle for instance.

The magnetic cap assembly 10 includes an external cap 11, a magnetic module (not numbered) and an internal cap 30. The magnetic module includes a holder 20 and four magnets 21 for example. The internal cap 30 and the magnetic module are inserted in the external cap 11. The magnetic module is located between the external cap 11 and the internal cap 30. Thus, the magnetic cap assembly 10 can attract an object made of a ferromagnetic material such as iron, nickel, cobalt and any alloy of iron, nickel and/or cobalt.

Figure 4:
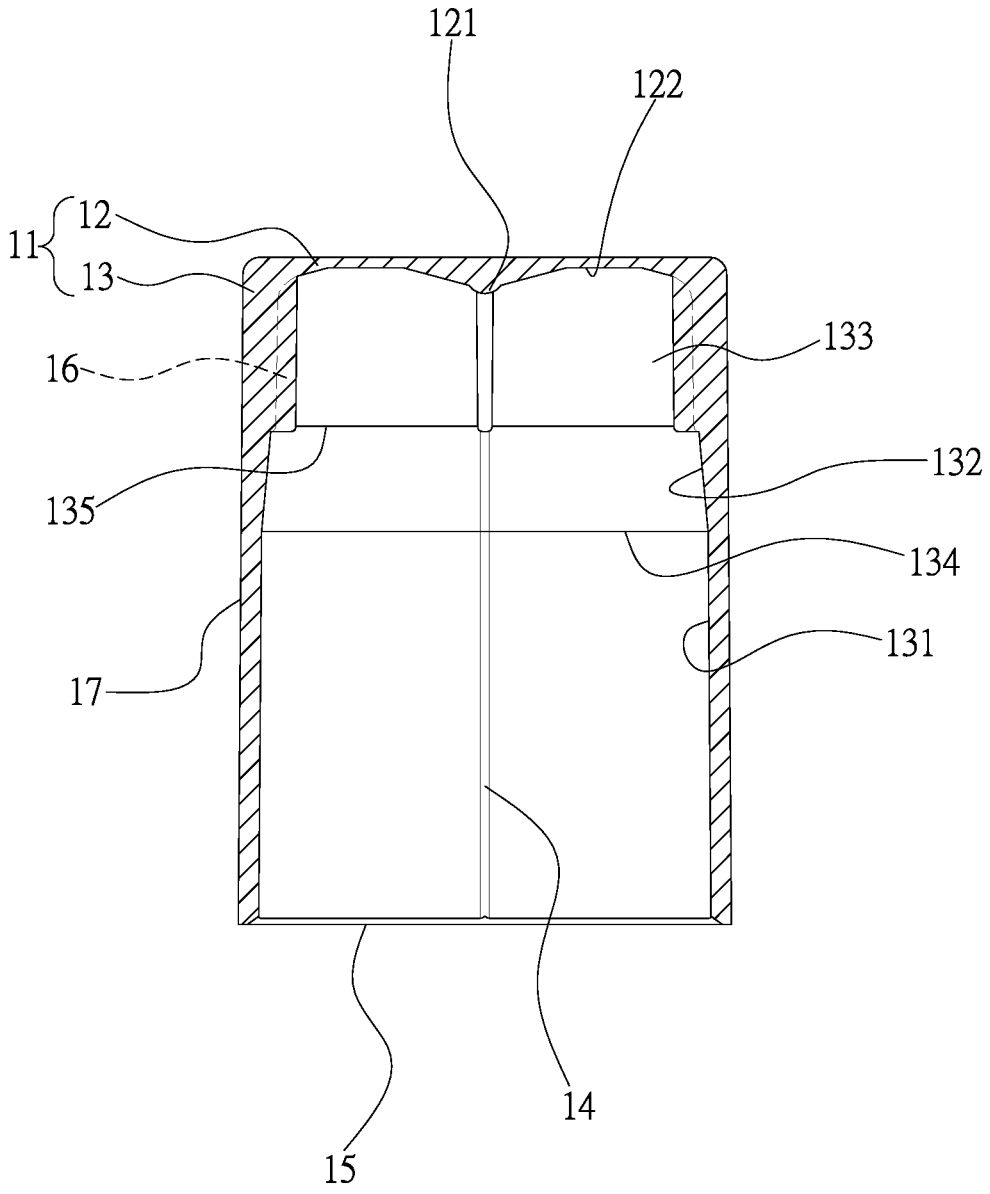
FIG. 4 is a cross-sectional view of an external cap of the magnetic cap assembly shown in FIG. 1.

Referring to FIGS. 1 and 4, the external cap 11 includes a ceiling 12, four walls 13 extending from the ceiling 12, four corners 14 each of which extends between two adjacent ones of the walls 13, and an open end 15 opposite to the ceiling 12. The ceiling 12 is square portion. Each of the walls 13 is a rectangular portion. The corners 14 are preferably chamfered. At least the ceiling 12 and each of the walls 13 is coated with a protective film 17. Preferably, the protective films 17 are provided with a color corresponding to the cosmetics.

Figure 2:
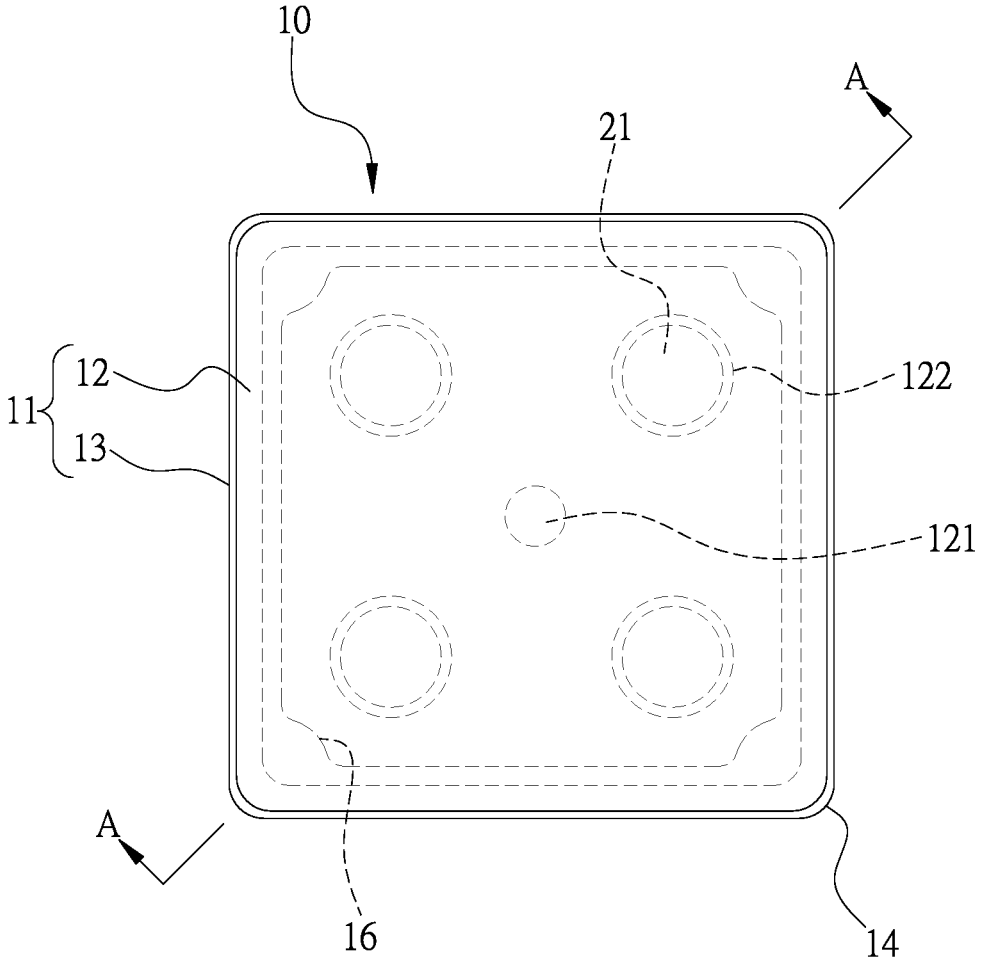
FIG. 2 is a top view of the magnetic cap assembly shown in FIG. 1.

Referring to FIGS. 2 and 4, the ceiling 12 includes a planar upper face. On a lower face, the ceiling 12 includes a boss 121 and four relatively thin portions 122. The boss 121 extends from a center of the lower face of the ceiling 12. The relatively thin portions 122 are located around the boss 121. Each of the relatively thin portions 122 is located between a corresponding one of the corners 14 and the boss 121.

Each of the walls 13 includes a planar external face. An internal face of each of the walls 13 includes three sections so that the interior of the external cap 11 includes a lower space 131 in the vicinity of the ceiling 12, an upper space 133 in the vicinity of the open end 15, and a conical space 132 between the lower space 131 and the upper space 133. The conical space 132 includes a large open end 134 next to the lower space 131 and a small open end 135 next to the upper space 133.

The external cap 11 further includes four tracks 16 located in the upper space 133. Each of the tracks 16 extends along a boundary between the internal faces of two adjacent ones of the walls 13. The tracks 16, the ceiling 12 and the walls 13 are made in one piece.

Figure 5:
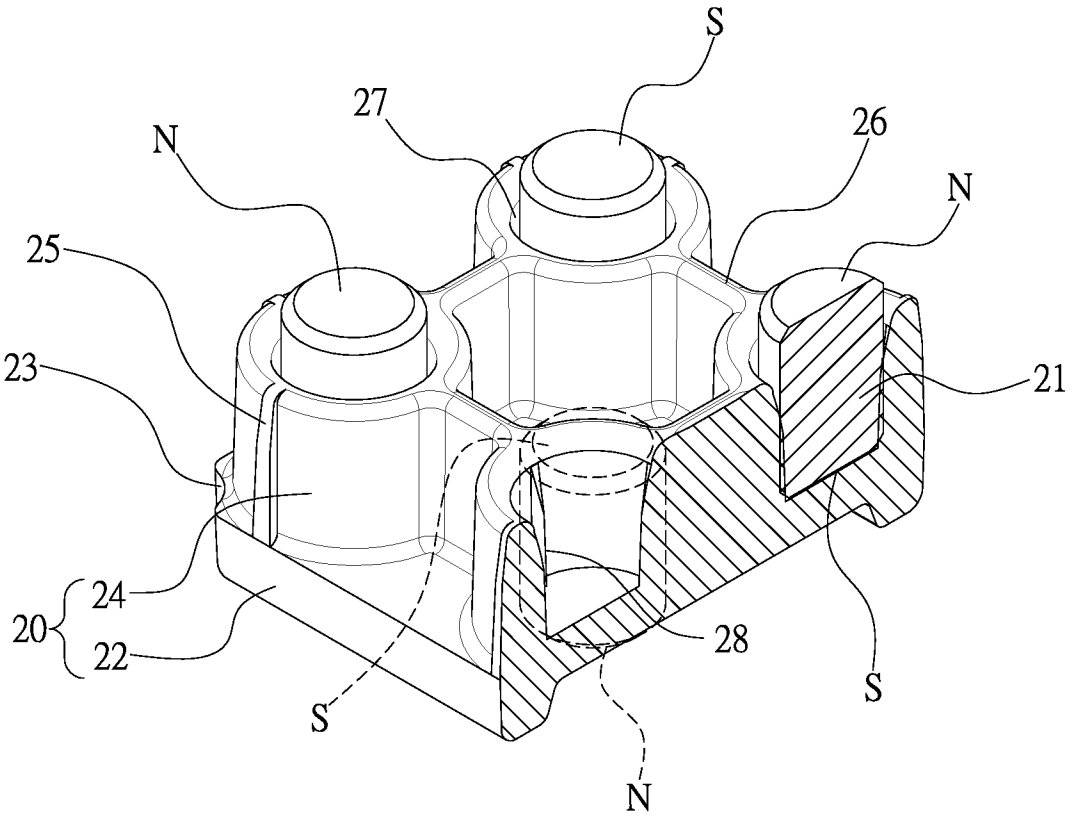
FIG. 5 is a cut-away view of a magnetic module of the magnetic cap assembly shown in FIG. 1.

Referring to FIG. 5, the magnetic module includes a holder 20 for holding four magnets 21 in position. The holder 20 includes a tray 22, four sockets 24 and four walls 26. The tray 22, the sockets 24 and the walls 26 are made in one piece.

The tray 22 is a square flat element. The tray 22 includes four cutouts 23 at four corners.

The sockets 24 extend from an upper face of the tray 22. Each of the socket 24 includes two external ribs 25, a cave 27 and four internal ribs 28. The external ribs 25 are used to enhance the strength of the sockets 24. The cave 27 of each of the sockets 24 receives a corresponding one of the magnets 21. The internal ribs 28 extend on the walls of the caves 27 of the sockets 24. Each of the internal ribs 28 includes a sharp edge. The sharp edges of the internal ribs 28 contact the magnets 21 and hence keep them in position.

The walls 26 extend from an upper face of the tray 22. Each of the four walls 26 interconnects two adjacent ones of the sockets 24.

Each of the magnets 21 includes two magnetic poles, i.e., pole S and pole N. The poles N of two of the magnets 21 at a diagonal line of the tray 22 are located out of the corresponding caves 27, and the poles S of these magnets 21 are inserted in the corresponding caves 27. The poles S of the remaining ones of the magnets 21 are located out of the corresponding caves 27, and the poles N of these two magnets 21 are inserted in the corresponding caves 27.

Figure 3:
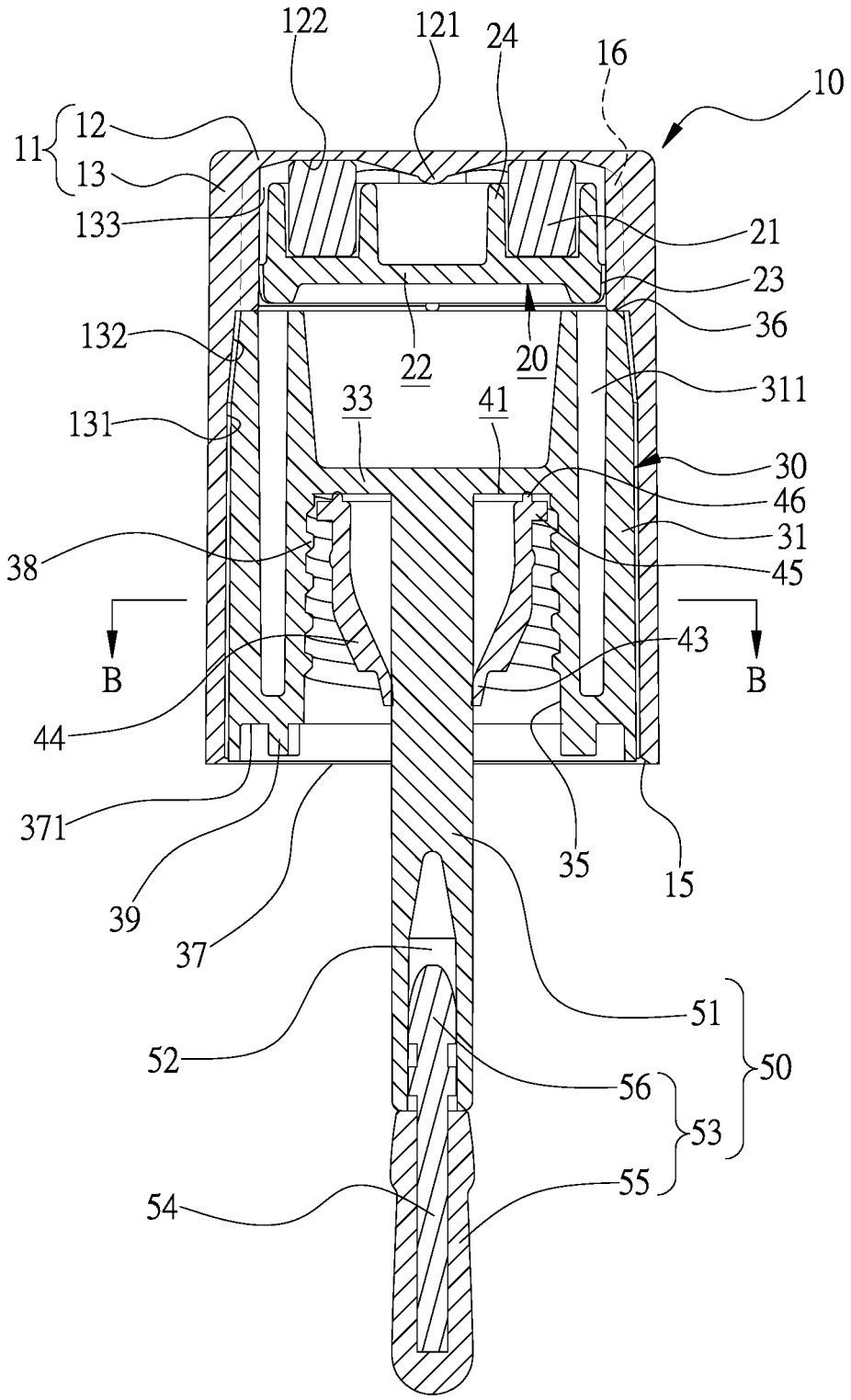
FIG. 3 is a cross-sectional view of the magnetic cap assembly taken along a line A-A shown in FIG. 2.

Referring to FIGS. 2 and 3, the magnetic module is inserted in the external cap 11. To this end, the magnetic module, which includes the holder 20 and the magnets 21, is moved toward the ceiling 12. The magnetic module is sequentially moved into the lower space 131, the conical space 132 and the upper space 133. The tracks 16 are inserted in the cutouts 23 so that the tray 22 is smoothly moved into the upper space 133. Each of the magnets 21 includes a magnetic pole inserted in a corresponding one of the sockets 24 and another magnetic pole in contact with a corresponding one of the relatively thin portions 122. Each of four edges (not numbered) of the tray 22 is in contact with a corresponding one of the walls 13 so that the holder 20 is not rotatable in the external cap 11. The boss 121 is not in contact with the magnets 21 or the sockets 24, and hence does not interfere with the insertion of the magnetic module into the external cap 11.

Figure 6:
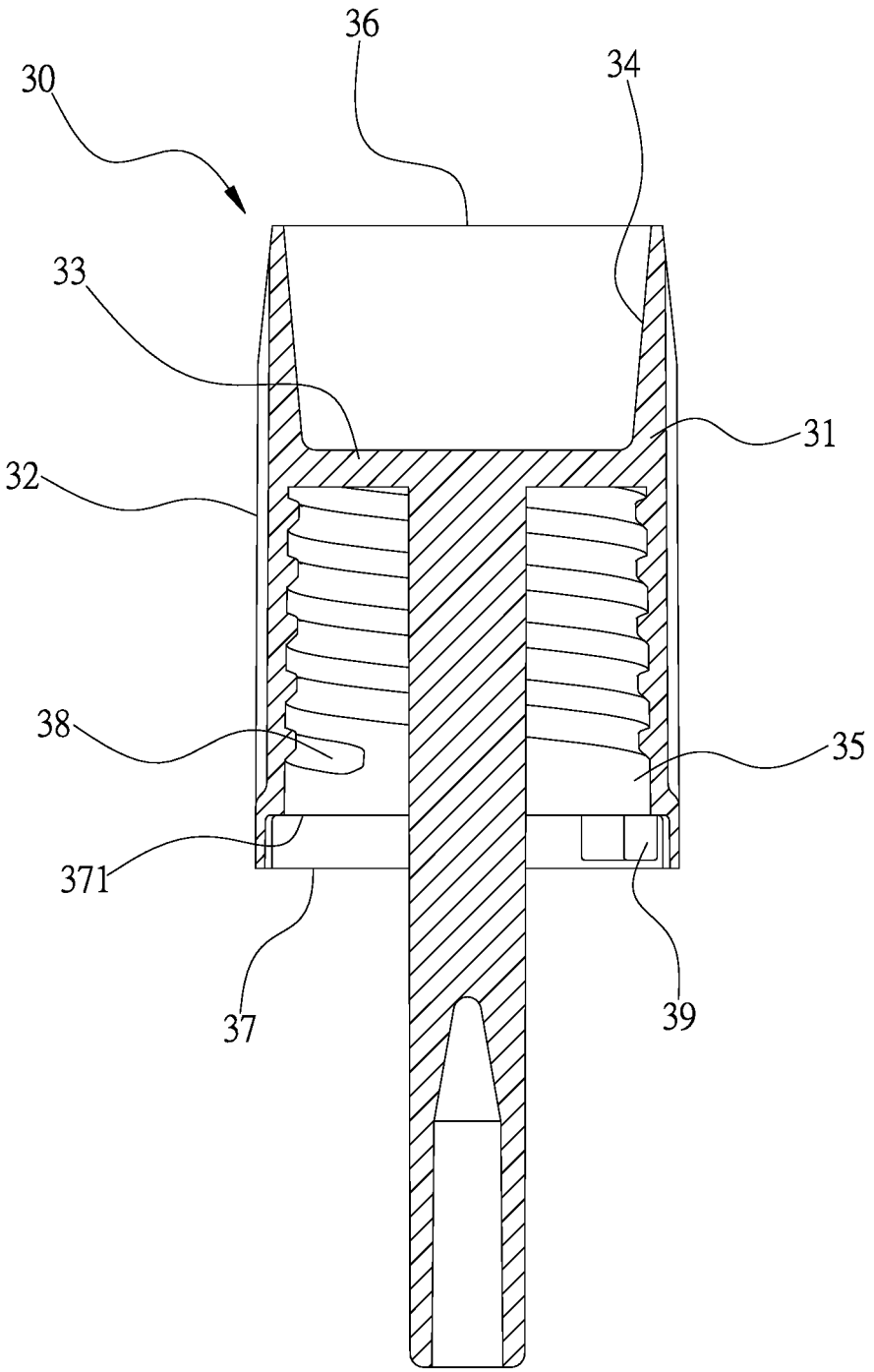
FIG. 6 is a cross-sectional view of an internal cap of the magnetic cap assembly shown in FIG. 1.

Referring to FIGS. 1 and 6, the internal cap 30 includes four walls 31 connected to one another and a partition 33 connected to the walls 31. The partition 33 enhances the strength of the internal cap 30. Each of the walls 31 is a rectangular portion that includes ribs 32 evenly formed on an internal face. The ribs 32 enhance the strength of the walls 31.

The walls 31 render the internal cap 30 a tubular element that includes an upper open end 36, a lower open end 37, a mass-reducing space 34 next to the upper open end 36 and an engaging space 35 next to the lower open end 37. The mass-reducing space 34 is separated from the engaging space 35 by the partition 33. The mass-reducing space 34 is used to reduce the mass of the internal cap 30. The engaging space 35 is a stepped space that includes two sections divided by a shoulder 371.

The internal cap 30 further includes four recesses 311, a thread 38 and elastic buckles 39. The recesses 311 are located around the mass-reducing space 34. The recesses 311 reduce the mass of the internal cap 30 like the mass-reducing space 34. The thread 38 extends on an internal face of a section of the internal cap 30 in the engaging space 35, between the partition 33 and the shoulder 371. The elastic buckles 39 are separated from one another by a gap. Each of the elastic buckle 39 extends from an internal face of a corresponding one of the walls 31, in the vicinity of the shoulder 371.

Figure 7:
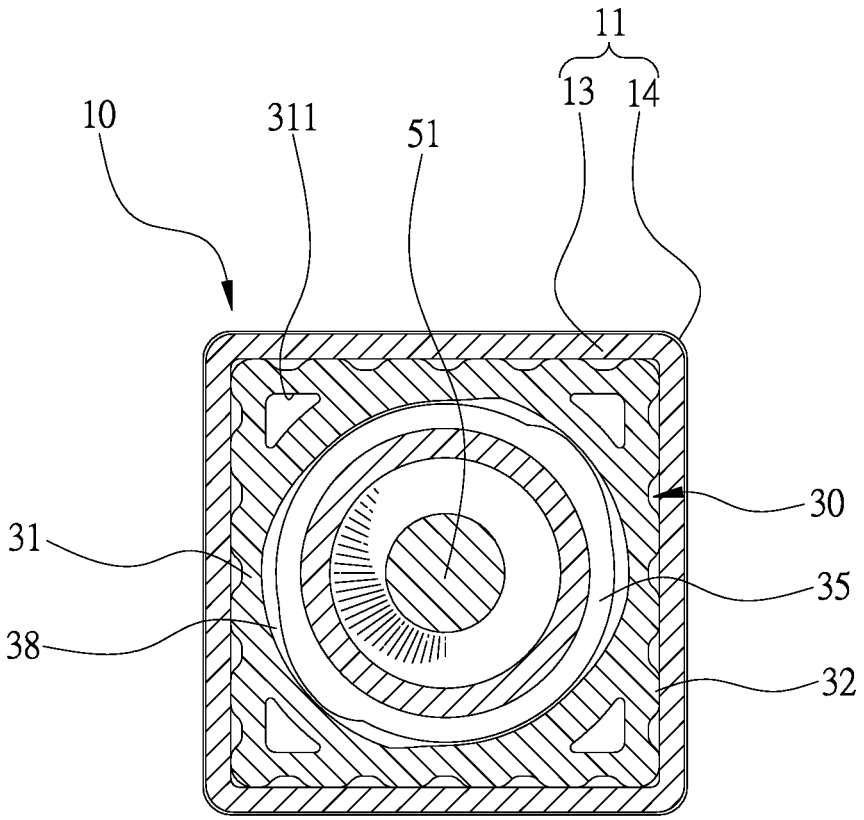
FIG. 7 is a cross-sectional view of the magnetic cap assembly taken along a line B-B shown in FIG. 3.

Referring to FIGS. 3 and 7, the internal cap 30 is inserted in the lower space 131 and the conical space 132 of the external cap 11. To this end, the upper end of the internal cap 30 is sequentially moved through the open end 15 of the external cap 11, the lower space 131 and the conical space 132. Finally, the tracks 16 are abutted against the upper open end 36 of the internal cap 30 to prevent the internal cap 30 from moving further into the external cap 11. Now, the open end 15 is almost completely covered by the internal cap 30, and the lower open end 37 is the only passageway through which an object can be inserted in the engaging space 35 of the magnetic cap assembly 10.

The ribs 32 of the internal cap 30 contact the walls 13 of external cap 11. The walls 13 of the external cap 11 squeeze the ribs 32 of the internal cap 30 while the ribs 32 of the internal cap 30 push the walls 13 of the external cap 11. Thus, the ribs 32 are deformed to a limited extent. Friction between the ribs 32 and the walls 13 keep the internal cap 30 in the external cap 11. That is, the internal cap 30 is fitted in the external cap 11. Thus, the holder 20 is kept in the upper space 133 of the external cap 11 by the internal cap 30. The magnets 21 are kept between the ceiling 12 of the external cap 11 and upper open end 36 of the internal cap 30.

Referring to FIGS. 1, 3, 6 and 7, the magnetic cap assembly 10 further includes a lash curler 50 according to the first embodiment of the present invention. The lash curler 50 includes a shank 51 and a bit 53. The shank 51 includes an upper end made in one piece with a lower face of the partition 33. The shank 51 extends along an axis of the engaging space 35 (or the thread 38) from the partition 33. A lower end located out of the shank 51 extends beyond the lower open end 37 of the internal cap 30 of the magnetic cap assembly 10 because the length of the shank 51 is larger than the depth of the engaging space 35. The shank 51 includes a bore 52 in the lower end.

The bit 53 includes a rod 54 and a piece of sponge 55. The rod 54 includes a mushroom-shaped portion 56 at an upper end. The mushroom-shaped portion 56 is made with a diameter marginally larger than a diameter of the bore 52. The mushroom-shaped portion 56 is fitted in the bore 52, thereby firmly connecting the bit 53 to the shank 51. The piece of sponge 55 is in the form of a tube. A lower section of the rod 54 is fitted in the piece of sponge 55.

Figure 8:
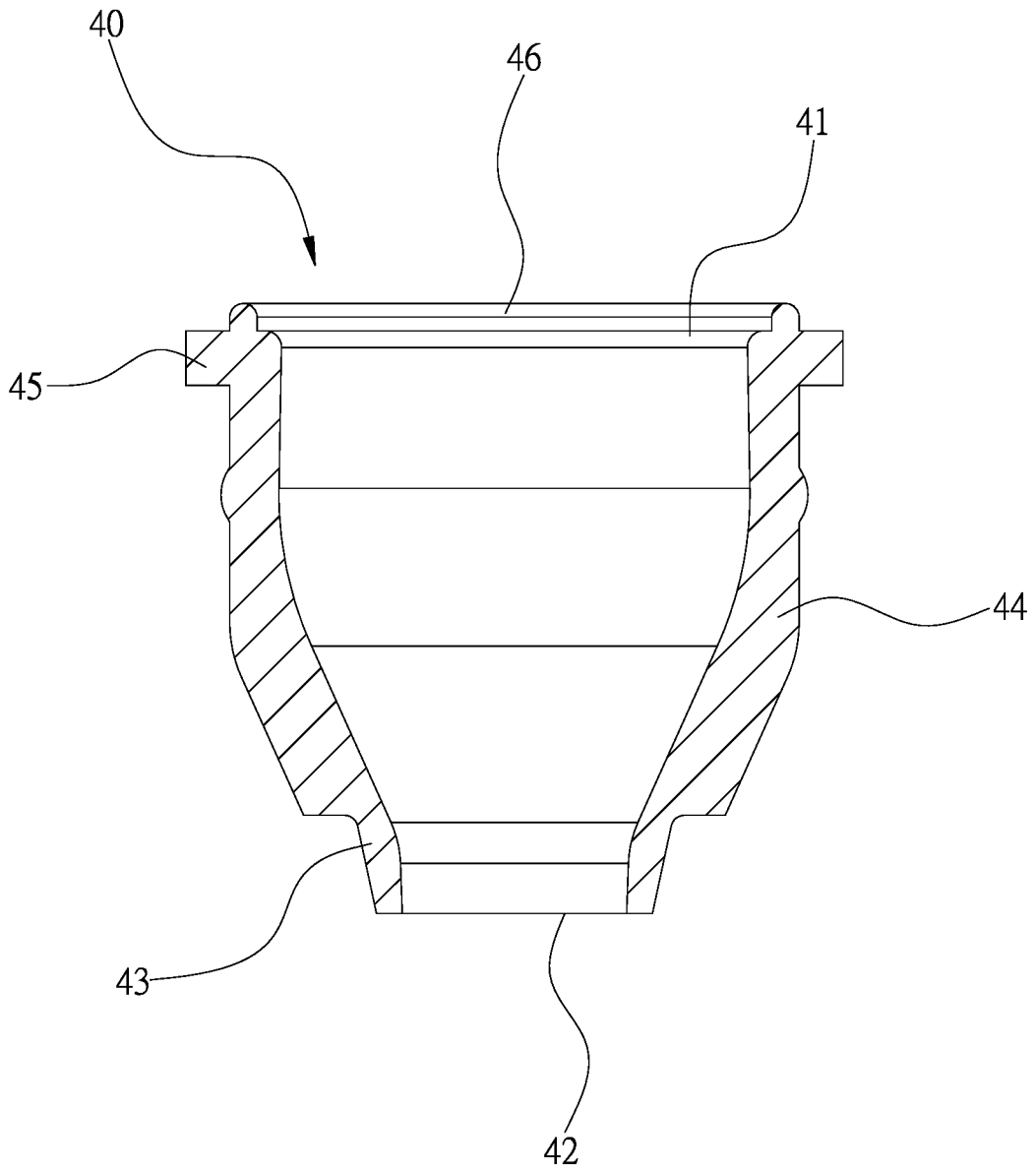
FIG. 8 is a cross-sectional view of a scrapper of the magnetic cap assembly shown in FIG. 1.

Referring to FIGS. 1, 3 and 8, the magnetic cap assembly 10 further includes a scrapper 40 according to the first embodiment of the present invention. The scrapper 40 further includes a bowl 44, a ferrule 43 extending from a lower end of the bowl 44, a gasket 46 extending from an upper end of the bowl 44, and a flange 45 extending from an external face of the bowl 44 in the vicinity of the gasket 46. The ferrule 43 extends around a small open end 42 of the scrapper 40. The gasket 46 extends around a large open end 41 of the scrapper 40.

Referring to FIG. 3, the scrapper 40 is inserted in the engaging space 35 of the internal cap 30. The bowl 44 of the scrapper 40 is located around the shank 51 of the lash curler 50. The large open end 41 is located in the vicinity of the partition 33. The gasket 46 is abutted against the partition 33. The ferrule 43 tightly holds on to the shank 51, thereby keeping the scrapper 40 on the shank 51. The scrapper 40 is used to prevent leakage.

Figure 9:
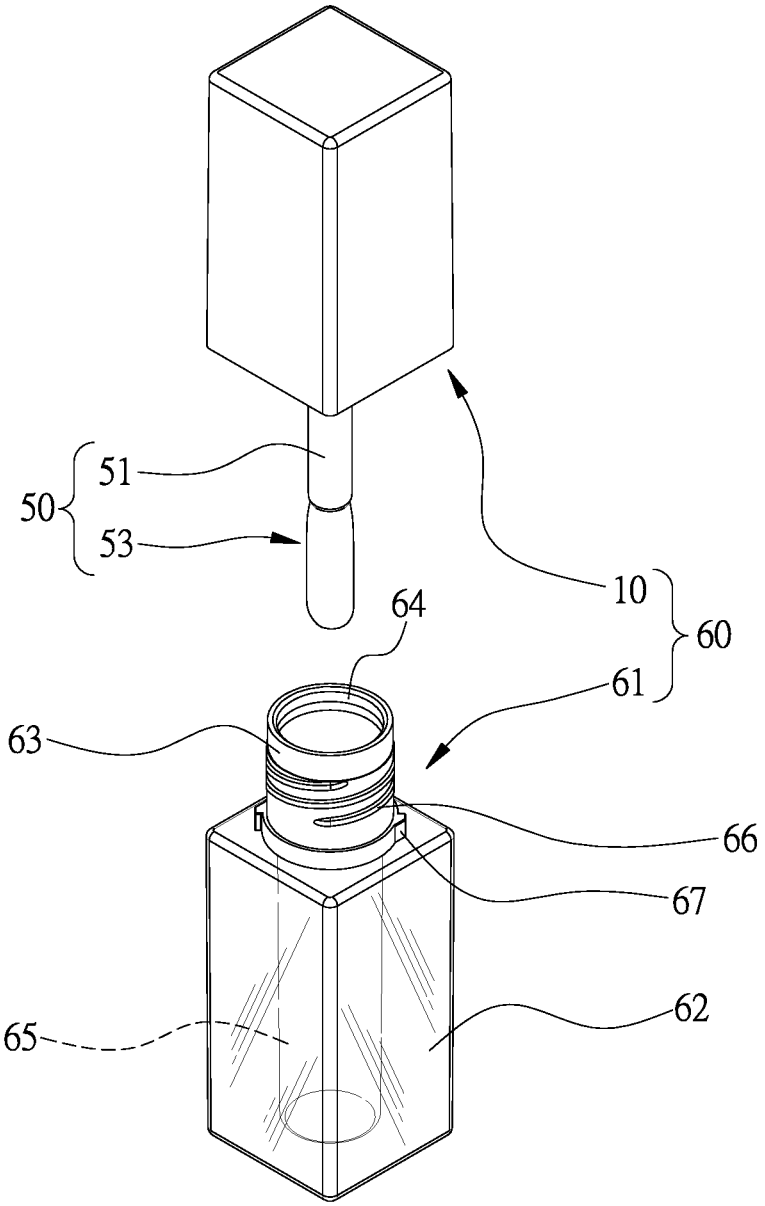
FIG. 9 is an exploded view of a container for nail polish that includes a bottle and the magnetic cap assembly shown in FIG. 1.

Referring to FIG. 9, a container 60 includes a bottle 61 in addition to the magnetic cap assembly 10. The bottle 61 includes a hollow body 62 and a bottle neck 63 extending from an upper end of the hollow body 62. The hollow body 62 includes a chamber 65 for containing mascara, lip gloss or any other proper type of cosmetics. The hollow body 62 is preferably transparent so that the mascara in the chamber 65 is visible through the hollow body 62. The bottle neck 63 includes a bottle mouth 64 via which the mascara is filled in or poured from the chamber 65. The bottle 61 further includes a thread 66 extending on an external face of the bottle neck 63 and locking portions 67 formed below the thread 66.

Referring to FIGS. 3 and 9, the lash curler 50 is inserted in the chamber 65 of the hollow body 62 via the bottle mouth 64. The bottle neck 63 can be inserted in and covered by the magnetic cap assembly 10 by engaging the thread 38 with the thread 66. The thread 38 is kept engaged with the thread 66 by engaging the elastic buckles 39 with the locking portions 67, even in cases of vibration. Thus, the bottle 61 is firmly closed by the magnetic cap assembly 10.

To take mascara from the bottle 61, the bit 53 is taken from the bottle 61 through the bottle mouth 64, which is made in the bottle neck 63. The sponge 55 may leave some of the mascara in the bottle mouth 64. When the magnetic cap assembly 10 covers the bottle neck 63, the bowl 44 of the scrapper 40 scraps and return the leftover mascara into the bottle 61 from the bottle mouth 64 so that it falls back into the of the chamber 65 of the hollow body 62.

Figure 10:
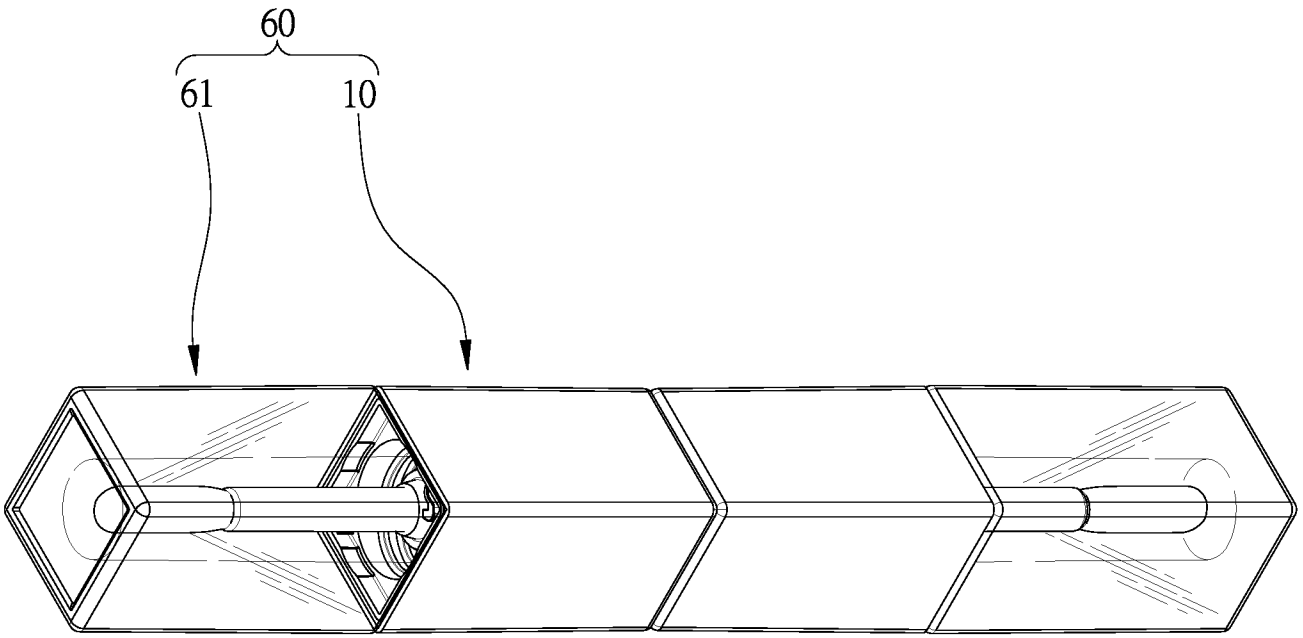
FIG. 10 is a perspective view of two containers as shown in FIG. 9 attracted to each other head to head.

Referring to FIG. 10, two containers 60 are attracted to each other, head to head. That is, the magnetic cap assemblies 10 are attracted to each other, head to head.

Figure 11:
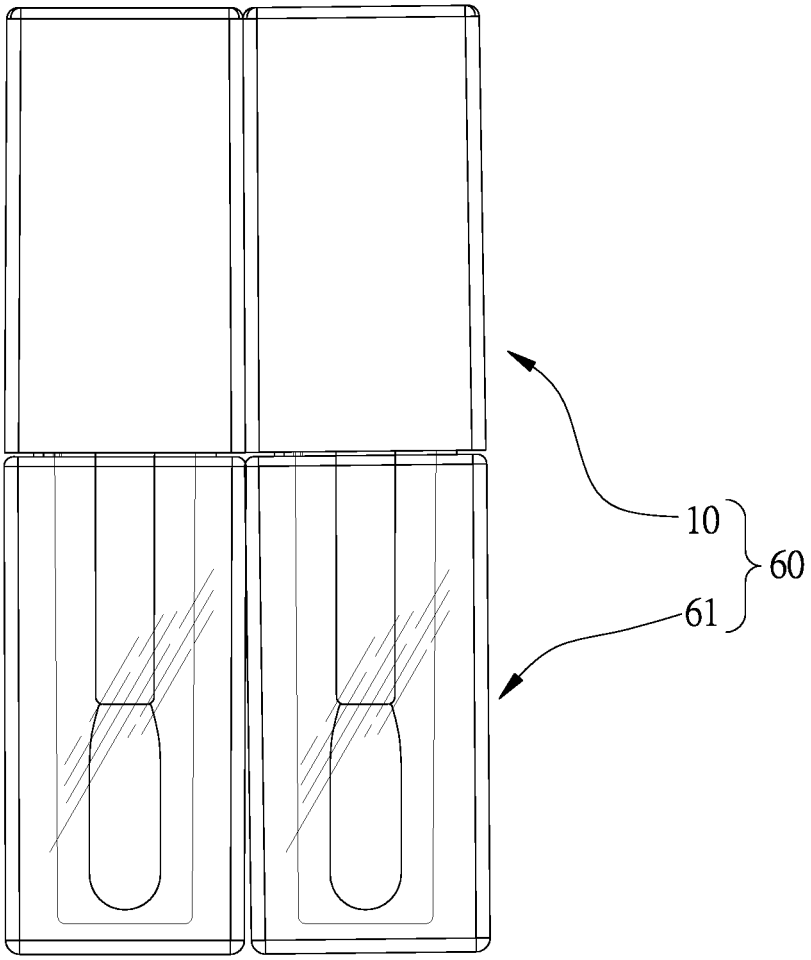
FIG. 11 is a perspective view of two containers as shown in FIG. 9 attracted to each other side by side.

Referring to FIG. 11, two containers 60 are attracted to each other, side by side. That is, the magnetic cap assemblies 10 are attracted to each other, side by side.

In the manner shown in FIG. 10 or 11, due to the magnetic attraction, the containers 60 are arranged in good order when they are located in a backpack, a purse, a handbag or the like. Thus, the containers 60 leave more space in the backpack, the purse or the handbag in such good order than otherwise. Moreover, it is easier to take the containers 60 from the backpack, the purse or the handbag in such good order than otherwise.

Figure 12:
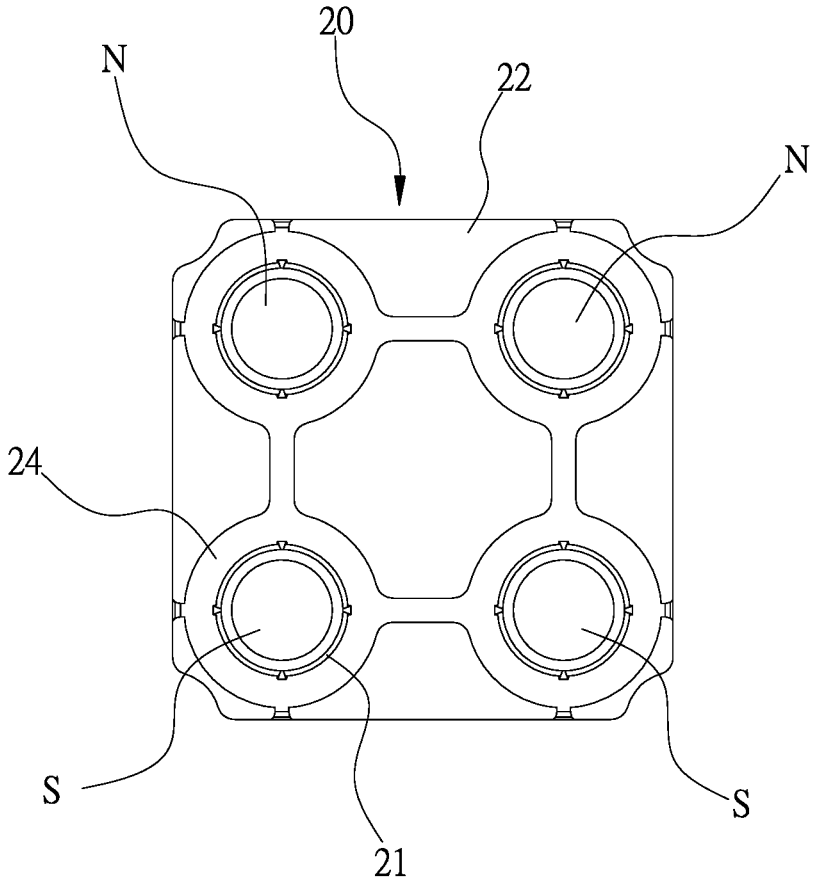
FIG. 12 is a top view of a magnetic module of a magnetic cap assembly according to a second embodiment of the present invention.

Referring to FIG. 12, there is shown a magnetic cap assembly according to a second embodiment of the present invention. The second embodiment is identical to the first embodiment except for the arrangement of the magnets 21 in the holder 20. The poles S of two of the magnets 21 arranged along a side of the holder 20 are located out of the corresponding sockets 24 and the poles N of the remaining ones of the magnets 21 are located out of the corresponding sockets 24.

Figure 13:
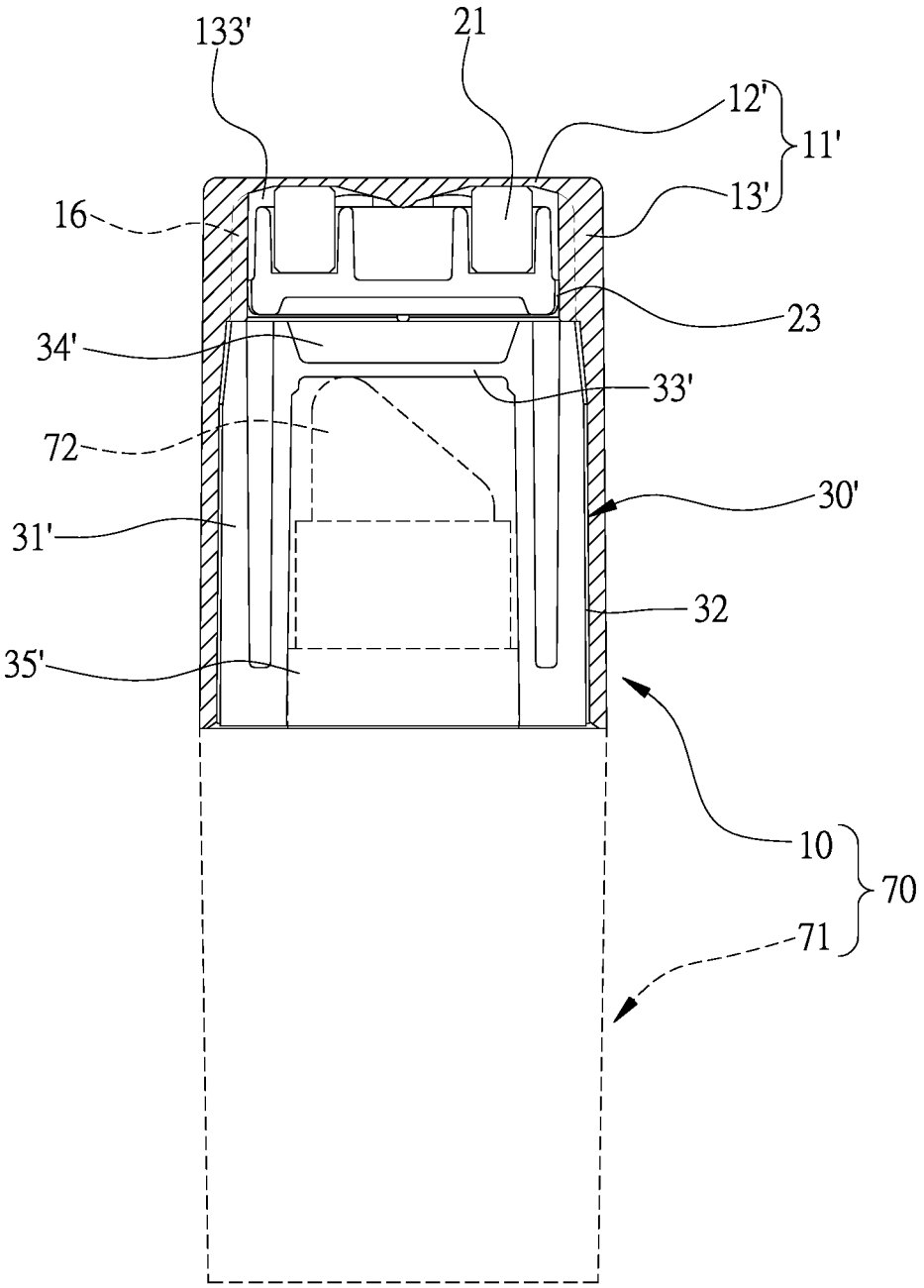
FIG. 13 is a cross-sectional view of a magnetic cap assembly according to a third embodiment of the present invention.
Figure 14:
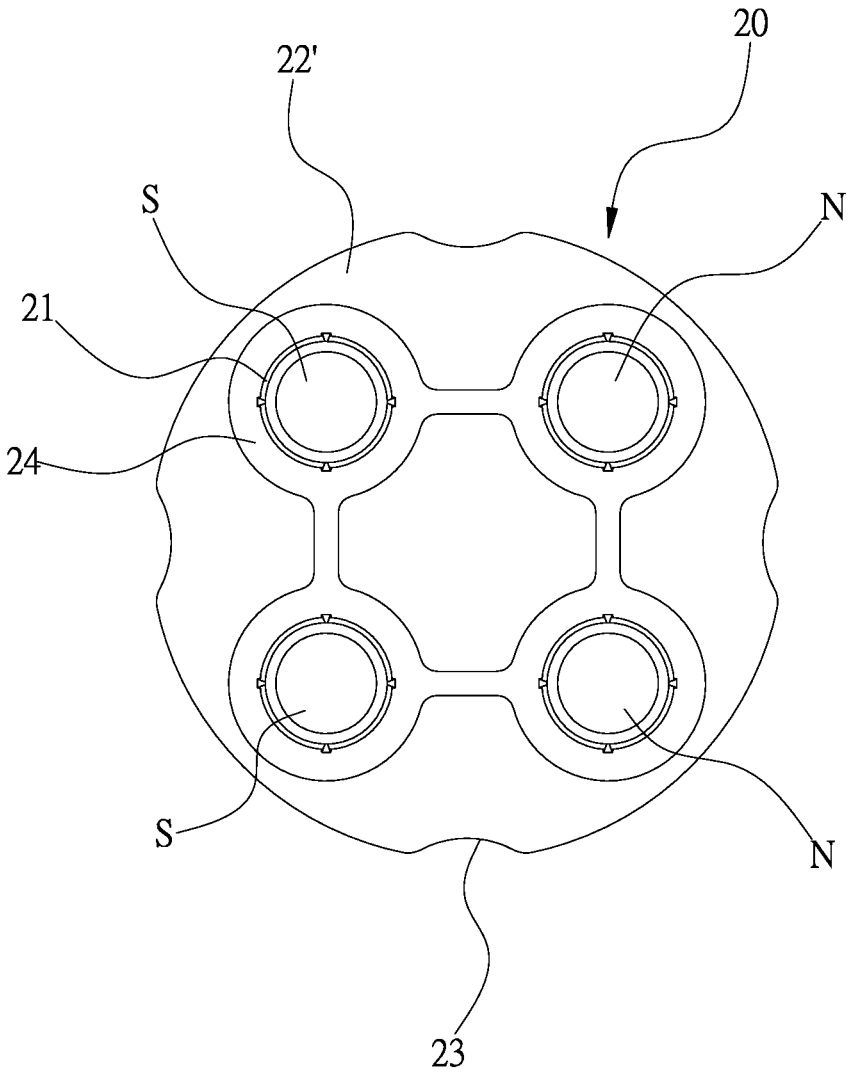
FIG. 14 is a top view of a magnetic module of the magnetic cap assembly shown in FIG. 13.

Referring to FIGS. 13 and 14, there is shown a magnetic cap assembly 10 according to a third embodiment of the present invention. The third embodiment is identical to the second embodiment except for several features. Firstly, an external cap 11' is used instead of the external cap 11. The external cap 11' includes a circular ceiling 12' and a cylindrical wall 13' instead of the square ceiling 12 and the walls 13. The external cap 11' includes a circular upper space 133' instead of the square upper space 133, and the holder 20 includes a circular tray 22' inserted in the circular upper space 133'.

Secondly, there is used an internal cap 30' that includes a cylindrical wall 13' instead of the walls 13 of the internal cap 30.

Thirdly, the internal cap 30' includes a partition 33' instead of the partition 33. The partition 33' is located higher in the internal cap 30' than the partition 33 in the internal cap. Thus, the internal cap 30' includes a mass-reducing space 34' shallower than the mass-reducing space 34 and an engaging space 35' deeper than the engaging space 35.

Fourthly, the internal cap 30' does not include any thread, shoulder, elastic buckles, lash curler or scrapper.

Figure 15:
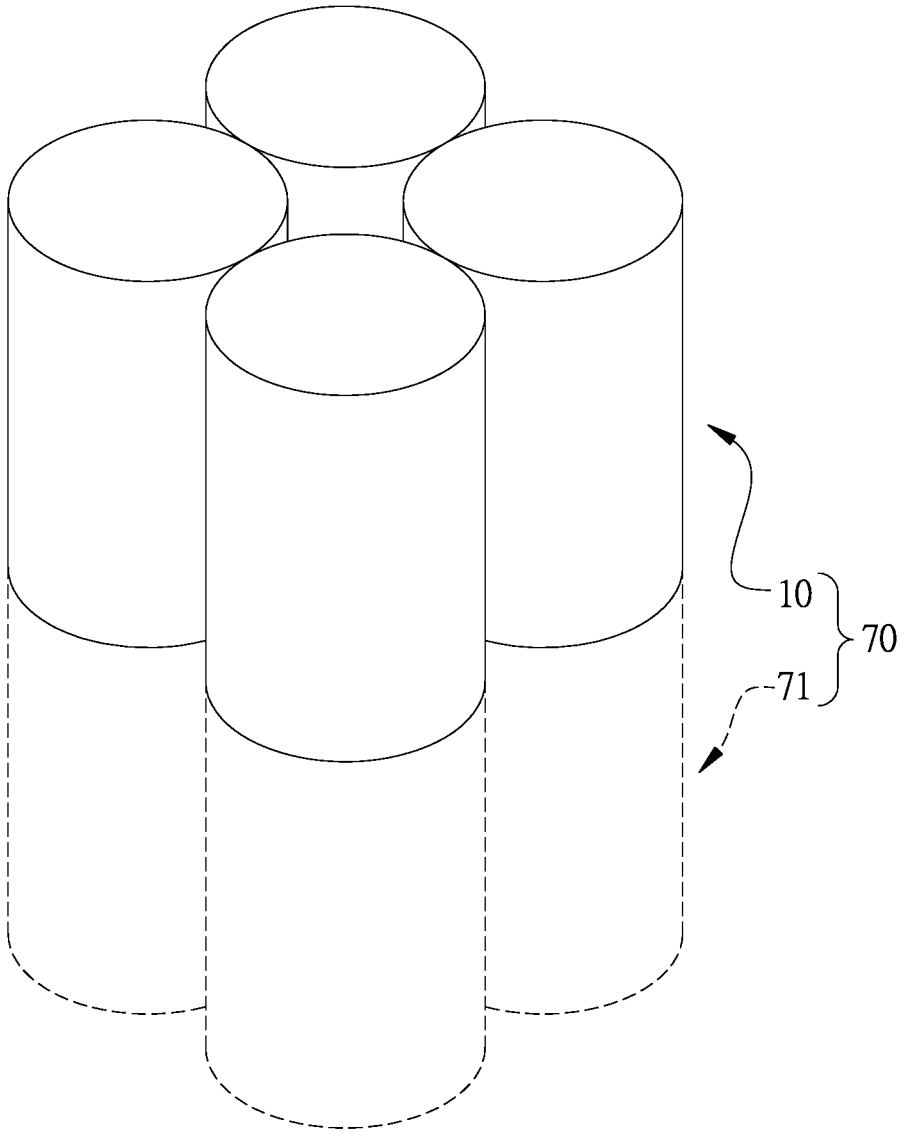
FIG. 15 is a perspective view of four containers equipped with magnetic cap assemblies as shown in FIG. 13, attracted to one another side by side.

Referring to FIG. 15, the magnetic cap assembly 10 is used in a container 70. The container 70 further includes a grip 71 for holding cosmetics 72 such as lip gloss.

Figure 16:
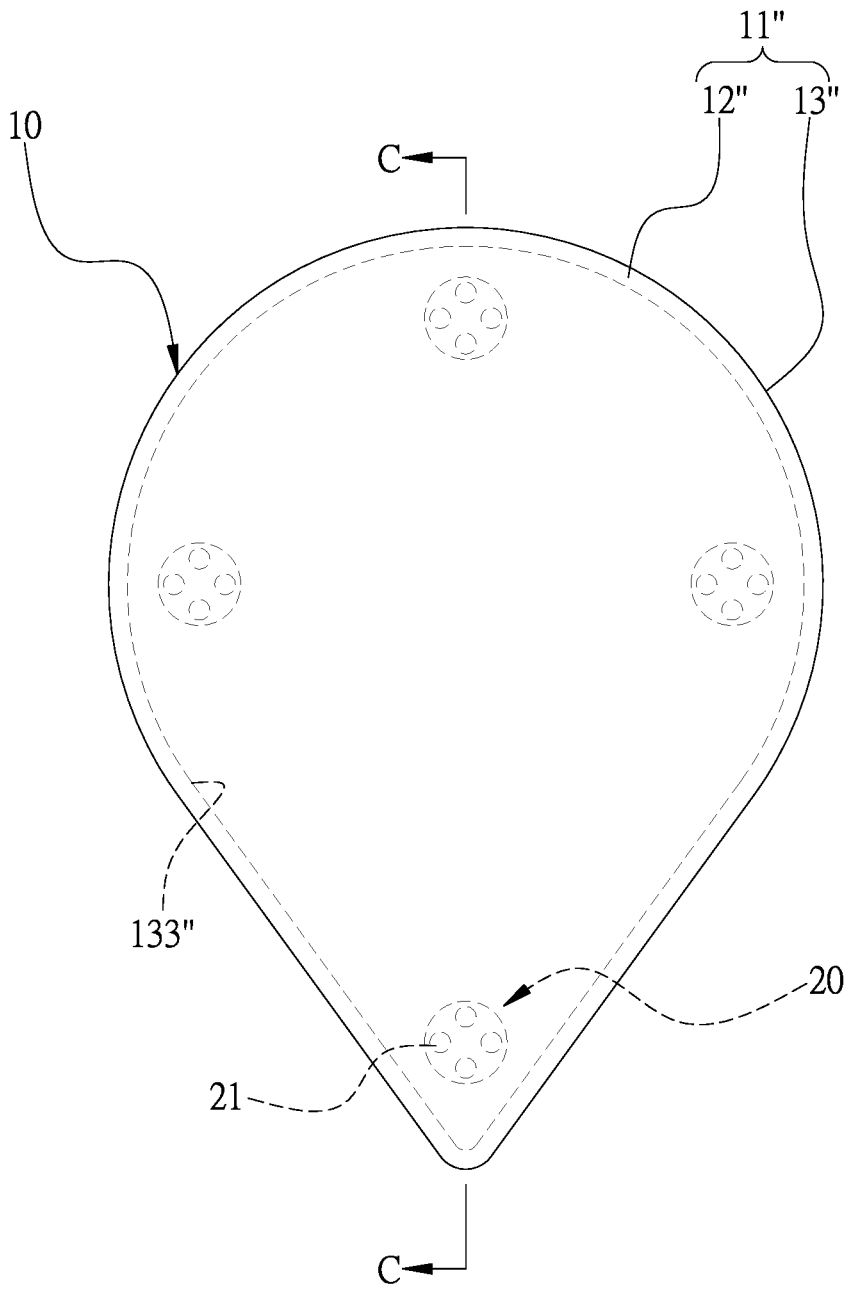
FIG. 16 is a top view of a container including a magnetic cap assembly according to a fourth embodiment of the present invention.

Referring to FIG. 16, a magnetic cap assembly 10 according to a fourth embodiment of the present invention is shown. The fourth embodiment is identical to the first embodiment except for several features. Firstly, an external cap 11" is used instead of the external cap 11. The external cap 11" includes a teardrop-shaped ceiling 12" and a wall 13" instead of the square ceiling 12 and the walls 13. Hence, the external cap 11" includes a teardrop-shaped upper space 133". The ceiling 12" does not include any boss, relatively thin portions or ribs. The wall 13" does not include any lower space or conical space.

Secondly, an internal cap 30" is included instead of the internal cap 30. The internal cap 30" is teardrop-shaped. The internal cap 30" includes a wall 31" and a partition 33". The partition 33" is in a different position in the wall 31" than the partition 33 in the wall 31. Hence, the depth of the engaging space 35" is different from the depth of the engaging space 35. The internal cap 30" does not include any mass-reducing space or thread.

The partition 33" includes four bores 75. Each of the bores 75 receives a magnetic module, which includes a holder 20 and four magnets 21. The magnetic modules are inserted in the upper space 133" of the external cap 11" by the internal cap 30".

Figure 17:
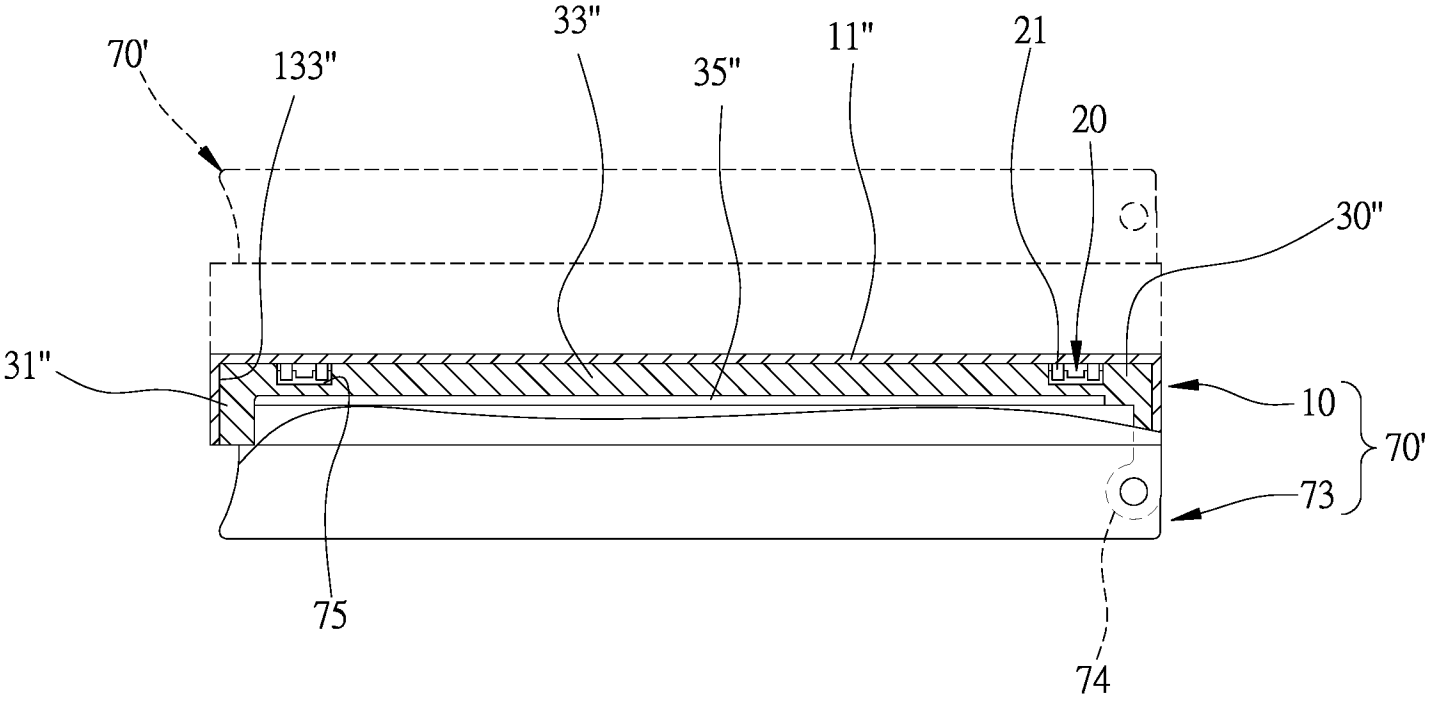
FIG. 17 is a cross-sectional view of the container taken along a line C-C shown in FIG. 16.

Referring to FIG. 17, two containers 70' are attracted to each other, head to head. Each of the containers 70' includes a box 73 and a magnetic cap assembly 10. The wall 31" includes a lug 74 pivotally connected to a box 73 by a pin (not numbered). The box 73 and the magnetic cap assembly 10 form a container 70'. The box 73 can be used to contain cosmetics in the form of powder.

Figure 18:
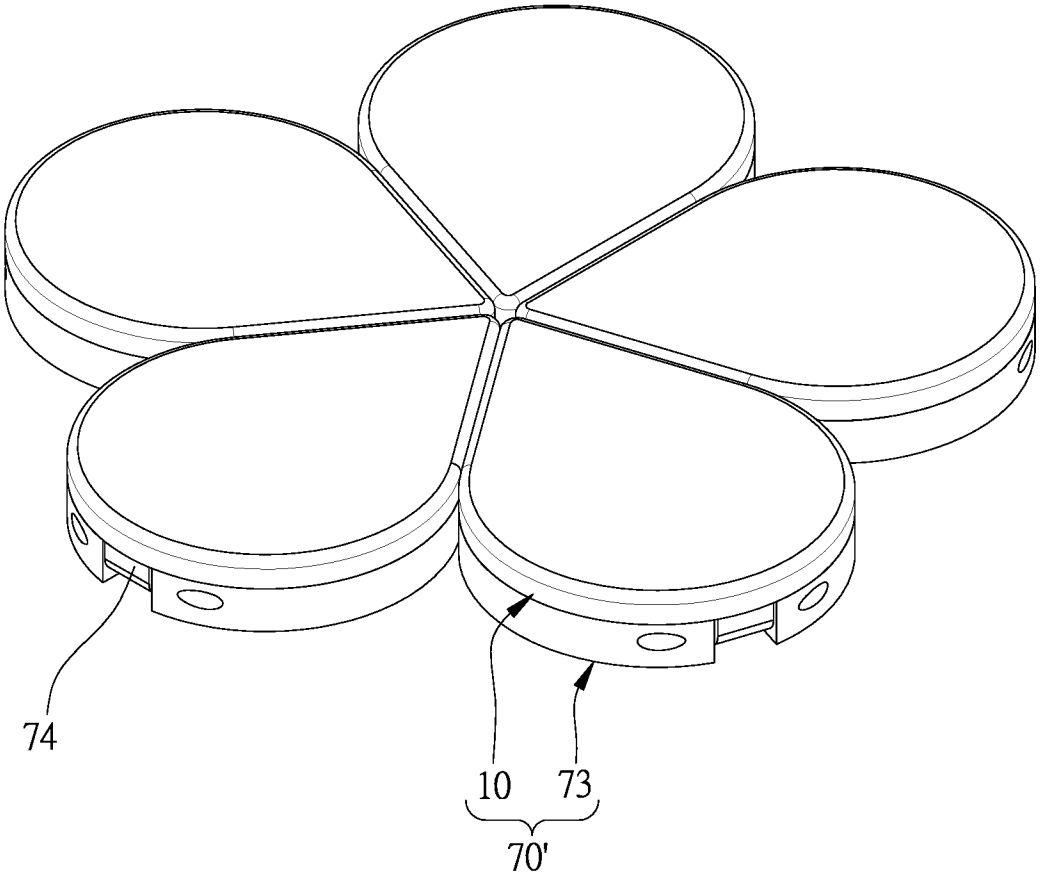
FIG. 18 is a perspective view of five containers as shown in FIG. 16, attracted to one another side by side.

Referring to FIG. 18, five containers 70' are attracted to one another. Hence, the combination of containers 70' looks like a flower.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A magnetic cap assembly comprising:

an external cap (11) comprising a ceiling (12) formed with relatively thin portions (122), thereby providing cavities;

a holder (20) comprising:

a tray (22) inserted in the external cap (11); and sockets (24) formed on the tray (22);

magnets (21) inserted in the sockets (24) of the holder (20) at an end and inserted in the cavities of the relatively thin portions (122) of the ceiling (12) of the external cap (11) at another end, wherein each of the magnets (21) is sandwiched by the ceiling (12) and the tray (22); and an internal cap (30) fitted in the external cap (11), thereby keeping the magnets (21) in the external cap (11).

2. The magnetic cap assembly according to claim 1, wherein the external cap (11) further comprises at least one wall (13) extending from the ceiling (12) so that the external cap (11) comprises:

an upper space (133) in the vicinity of the ceiling (12);

a lower space (131); and a conical space (132) comprising a small open end (135) in communication with the upper space (133) and a large open end (134) in communication with the lower space (131).

3. The magnetic cap assembly according to claim 2, wherein the internal cap (30) comprises:

at least one wall (31') comprising a space; and a partition (33') formed in the at least one wall (31'), thereby dividing the space of the at least one wall (31') into:

a mass-reducing space (34) with an upper open end (36); and an engaging space (35') with a lower open end (37), wherein the internal cap (30) keeps the magnets (21) in the upper space (133') of the external cap (11') and lower open end (37) of the internal cap (30') becomes a lower open end of the entire magnetic cap assembly (10) when the internal cap (30') is fitted in the lower space (131) of the conical space (132).

* * * * *